US006910717B1

(12) United States Patent
Moyer

(10) Patent No.: US 6,910,717 B1
(45) Date of Patent: Jun. 28, 2005

(54) OUTSIDE-HINGED COVER FOR PROTECTING ARTICLES STORED THEREIN AND METHOD FOR FABRICATING SAME

(76) Inventor: William Frederick Moyer, 15 James Farm, Lee, NH (US) 03824-6529

( * ) Notice: Subject to any disclaimer, the term of this patent is extended or adjusted under 35 U.S.C. 154(b) by 354 days.

(21) Appl. No.: 09/996,236

(22) Filed: Nov. 28, 2001

(51) Int. Cl.[7] ..... B42D 3/06

(52) U.S. Cl. ..... 281/15.1; 402/73; 412/4; 206/312; 206/472

(58) Field of Search ..... 281/15.1, 16, 17, 281/18, 19.1, 35, 51; 402/73, 74; 412/4, 5; 206/308.1, 312, 313, 387.13, 472, 473

(56) References Cited

U.S. PATENT DOCUMENTS

| | | | | |
|---|---|---|---|---|
| 2,435,856 A | | 2/1948 | Weingart | 129/20 |
| 3,629,967 A | | 12/1971 | Bass | 46/1 L |
| 3,945,140 A | * | 3/1976 | Sullivan et al. | 40/530 |
| 3,949,872 A | | 4/1976 | Paudras | 206/310 |
| 3,957,287 A | | 5/1976 | Hall et al. | 281/21 R |
| D260,122 S | | 8/1981 | Turner | D3/35 |
| 4,299,410 A | | 11/1981 | Jukola | 281/21 R |
| 4,488,737 A | | 12/1984 | Jacobs et al. | 281/31 |
| 4,588,321 A | | 5/1986 | Egly | 402/77 |
| 4,613,044 A | | 9/1986 | Saito et al. | 206/444 |
| 4,620,630 A | | 11/1986 | Moss | 206/45.24 |
| 4,640,413 A | | 2/1987 | Kaplan et al. | 206/232 |
| 4,793,477 A | | 12/1988 | Manning et al. | 206/232 |
| D304,781 S | | 11/1989 | Hanson | D3/35 |
| D304,880 S | | 12/1989 | Philosophe | D3/35 |
| D324,609 S | | 3/1992 | Yasuhara et al. | D3/35 |
| 5,253,751 A | | 10/1993 | Wipper | 206/45.19 |
| 5,279,097 A | | 1/1994 | Weisburn et al. | 53/449 |
| 5,289,918 A | | 3/1994 | Dobias et al. | 206/312 |
| 5,308,208 A | | 5/1994 | Ranson | 412/5 |
| 5,330,229 A | | 7/1994 | Zoltner | 281/15.1 |
| 5,332,089 A | | 7/1994 | Tillett et al. | 206/310 |
| 5,340,155 A | | 8/1994 | Podosek | 281/29 |
| 5,351,823 A | * | 10/1994 | Kollinek | 206/387.13 |
| 5,370,224 A | | 12/1994 | Karakane et al. | 206/309 |
| 5,472,083 A | | 12/1995 | Robinson et al. | 206/308.1 |
| D369,106 S | | 4/1996 | Baker et al. | D9/433 |
| 5,513,749 A | | 5/1996 | Simmons | 206/308.1 |
| 5,522,500 A | | 6/1996 | Mori | 206/308.1 |
| 5,559,030 A | | 9/1996 | Matsuyama et al. | 435/280 |
| 5,573,120 A | | 11/1996 | Kaufman et al. | 206/755 |

(Continued)

FOREIGN PATENT DOCUMENTS

EP 0 493 983 A1 7/1992

*Primary Examiner*—Jacob K. Ackun, Jr.
(74) *Attorney, Agent, or Firm*—Kevin M. Drucker; Steve Mendelsohn

(57) ABSTRACT

An object resembling the cover of a hardbound book comprises two panels connected by a spine. The outside hinge configuration of the invention prevents the spine from collapsing, even if there are no contents between the two panels. The invention lends itself to a wide variety of book-like products (e.g., a book-like holder for a compact disc and accompanying booklet) where the contents are of changing width (thickness) or where the spine must be of a specific width, irrespective of the width of the contents, and further allows for a binding for a book to be fabricated prior to assembly or insertion of its pages. A hinged cover consistent with the invention comprises a spine and two rigid panels, each panel coupled to the spine and disposed rotatably with respect to the spine, and the spine serves as a hinge stop for each rigid panel, such that each panel, when rotated toward the other panel, is constrained from rotating substantially beyond 90 degrees with respect to the spine. A method of constructing a cover consistent with the invention comprises disposing a rigid front, rear, and spine panel core onto a sheet of pliable material, such that the width of the space between the spine panel core and the other panel cores is based on at least the sum of the thickness of the spine panel core and twice the thickness of the sheet of pliable material.

22 Claims, 12 Drawing Sheets

U.S. PATENT DOCUMENTS 5,609,250 A * 3/1997 Moser ..... 206/387.13
5,634,666 A 6/1997 Lee ..... 281/20
5,669,491 A 9/1997 Pettey ..... 206/232
5,672,022 A * 9/1997 Lin ..... 402/73
5,685,424 A 11/1997 Rozek et al. ..... 206/308.1
5,730,284 A 3/1998 Farrah ..... 206/308.3
5,743,390 A 4/1998 Pozzoli ..... 206/232
5,748,608 A 5/1998 Spector ..... 369/291
5,769,217 A 6/1998 Derraugh et al. ..... 206/308.1
5,775,490 A 7/1998 Baker et al. ..... 206/308.1
5,775,491 A 7/1998 Taniyama ..... 206/308.1
5,806,672 A 9/1998 Bosworth ..... 206/310
5,833,063 A 11/1998 Ho ..... 206/308.1
5,950,821 A * 9/1999 Moser ..... 206/308.1
6,039,494 A * 3/2000 Pearce ..... 402/73
6,092,650 A 7/2000 Budnik ..... 206/232
6,105,762 A 8/2000 Pettey ..... 206/232
6,106,015 A 8/2000 Udwin et al. ..... 281/29
6,109,432 A 8/2000 Pozzoli ..... 206/232
6,250,867 B1 * 6/2001 Gwyn et al. ..... 412/19
6,276,523 B2 8/2001 Sanders ..... 206/308.1

* cited by examiner

OUTSIDE-HINGED COVER FOR PROTECTING ARTICLES STORED THEREIN AND METHOD FOR FABRICATING SAME

BACKGROUND OF THE INVENTION

1. Field of the Invention

The present invention relates, generally, to protective covers for housing various items, and more particularly, to a book-like outside-hinged cover for packaging, housing and protecting items such as stamp collections, photographs, compact discs, cassettes, and other electronic storage media.

2. Description of Related Art

With reference now to FIG. 1A, an exemplary typical hardcover book 10 known in the art comprises a plurality of pages 12 and a cover 14 (referred to as the book's "case" in the bookbinding arts) having two panels 15, 16, a spine 17, and two hinges 18, 19, with one hinge 18, 19 on either side of the spine 17. The plurality of pages 12 forms a support structure for the panels 15, 16 of the cover 14, keeping the spine 17 at substantially a right angle with respect to the panels 15, 16. As illustrated in FIG. 1B, if all the pages 12 are removed from the book 10' and the book 10' is shut, the spine 17 will collapse. This occurs because, as one hinge 19 opens, the spine 17 approximates one panel 15 of the cover 14 as the angle between the two at the hinge 19 decreases, and as the other hinge 18 closes, the spine 17 moves away from the other panel 16 of the cover 14 as the angle between the two at the hinge 18 increases. The thickness of the book 10' that remains (i.e., only the cover 14) will equal approximately the combined thickness of one cover panel 15 and the other cover panel 16.

Illustrated another way, FIG. 1C shows a typical hardbound book 70, which comprising a cover 76 having a front panel portion 71, a rear panel portion 72, and a spine portion 73, and is hinged on the inside of the spine 73. In this inside-hinge configuration, the front 71 and rear 72 panels both rotate about the spine panel 73 by means of hinges 78, 79 formed in a pliable material between the front 71 and rear 72 panels and the spine panel 73, wherein the axes of rotation are located toward the inside of the book 70, away from the spine panel 74. This inside-hinge configuration limits the inward rotational travel of the front 71 and rear 72 panels toward one another solely based on the thickness of the plurality of pages contained within the cover 76. If the plurality of pages is not attached, either directly or indirectly, to the spine 73, then appropriate support for the front 71 and rear 72 panels may not be provided when the panels 71, 72 are shut.

Thus, in order for a typical hardcover book to maintain its rigidity while shut, the following two requirements must be met: (1) the width (thickness) of the spine must be approximately equal to the combined thickness of the front panel, the contents, and the back panel; and (2) the inside of the spine must be attached at nearly all points along its length to the contents of the cover.

Numerous situations exist in which the foregoing two conditions cannot be met, e.g., a photo album or stamp album that is not completely filled with pages, or a book holding compact discs (CDs), cassettes, diskettes, or other data storage or recording media. Prior art solutions to the problem of the collapsing spine include three-ring binders, certain photo albums, and holders for storing CDs. The three-ring binder or notebook maintains a rigid spine because of the rigidity of the metal rings, which also serve to retain the pages. Some photo albums have screws for retaining the pages, which also aid in maintaining the spine's rigidity.

Known solutions to the problem of the collapsing spine, e.g., the common CD packages known as "jewel boxes", introduce other deficiencies, some of which exist partly because the universal standard width of a CD package is 5/16", despite the fact that the combined thickness of a CD and the printed material accompanying the CD is usually less than 1/8". Made of plastic, the jewel box is easily cracked, the hinge is easily broken, the front panel is hard to open, the booklet is difficult to remove and to replace, the general look is ordinary and mass-produced, and the excessive amount of plastic contributes to the problem of pollution. An exemplary alternative to the jewel box might be a hardcover booklet, wherein the combined thickness of the front panel, the boss that holds the CD onto the inside of one panel, the booklet glued onto the other panel, and the back panel, equals 5/16". However, since the inside of the spine cannot feasibly be attached at all points to the contents of the booklet, the spine still collapses.

SUMMARY OF THE INVENTION

The present invention provides an outside-hinged cover that will maintain rigidity when shut, even if (1) the width (thickness) of the spine is not approximately equal to the combined thickness of the front panel, the contents, and the back panel; and/or (2) the inside of the spine is not attached at nearly all points along its length to the contents of the book. A cover constructed in a manner consistent with this invention prevents the spine from collapsing, even if there are no contents between the two panels.

FIGS. 2 and 2A illustrate an exemplary book-like object 80 comprising an exemplary outside-hinged cover 86 consistent with the invention. The cover 86 has a front panel portion 82, a rear panel portion 83, and a spine portion 81, and is hinged on the outside of the spine 81. In this outside-hinge configuration, the front 82 and rear 83 panels both rotate about the spine panel 81 by means of hinges 88, 89 formed in a pliable material between the front 82 and rear 83 panels and the spine panel 81, wherein the axes of rotation are located on the outside of the book-like object 80, at or adjacent the spine panel 81. As described in further detail hereinbelow, this outside-hinge configuration limits the inward rotational travel of the front 82 and rear 83 panels toward one another based, not on the thickness of the plurality of pages contained within the cover 86, but instead, based on the configuration of the front 82 and rear 83 panels with respect to the spine panel 81, wherein the spine panel 81 serves as a hinge stop for the front 82 and rear 83 panels. Regardless of whether or not a plurality of pages (or other contents) is attached to the spine 81 of the cover 86, appropriate support for the front 82 and rear 83 panels is provided when the panels 82, 83 are shut.

The invention may have utility in books, book-like objects, covers, cases, holders, packages, or other protective or storage devices. A hinged cover consistent with the invention may be constructed with particular sensitivity to the environment, as the materials thereof may comprise organic materials such as cloth, cardboard and paper (instead of, e.g., plastic). Since most or all of the parts may be formed from rectangular pieces, there will be almost no wasted materials when parts are cut. A hinged cover consistent with the present invention may have particular utility as a CD holder that resembles a hardbound book, and may also take the form of a book-like object for storing other recorded or stored material or data, so that such packaging can be sturdier, more attractive, easier to open, and less environmentally detrimental than standard designs.

BRIEF DESCRIPTION OF THE DRAWINGS

FIG. 5 is a top perspective view of an exemplary hinged cover consistent with the invention wherein the inside liner sheet is placed and glued on;

DETAILED DESCRIPTION OF EXEMPLARY EMBODIMENTS

Figure 3:
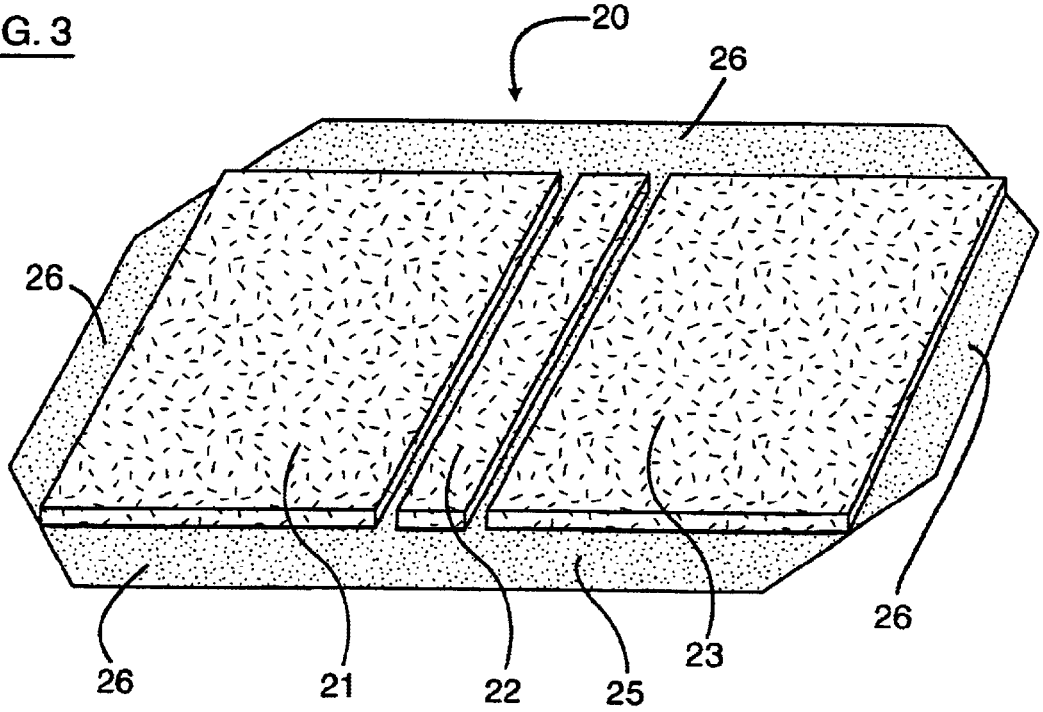
FIG. 3 is a top perspective view of an exemplary hinged cover consistent with the invention in its initial phase of construction, wherein the panel cores are placed on the cover prior to being affixed thereto.

Turning now to FIG. 3, an exemplary packaging hinged cover (or "book") 20 consistent with the invention in its initial phase of construction is illustrated. First, the cover 25 is laid out flat, and if the outside of the hinged cover is to be printed, then the printed side faces down. Next, glue (not shown) is spread onto the exposed side of the cover 25. As shown, three panel cores—a front 21, spine 22, and rear 23 panel core—are placed on the cover 25 prior to being affixed thereto. Resultant overhanging flaps 26 extend beyond the panel cores 21–23, each flap 26 in this exemplary embodiment having an isosceles trapezoidal form (although it should be noted that the flaps 26 could alternatively be convex hexagonal or rectangular forms to accommodate the thickness of the panels, or other geometric forms). The front 21 and rear 23 panel cores have the same length, width (thickness), and height, and the spine panel core 22 has the same width as the front 21 and rear 23 panel cores, although it is not necessary that the cores 21–23 are sized in this relationship to one another (e.g., the spine panel core 22 could be thicker than the other cores 21–23). The front 21 and rear 23 panel cores and spine panel core 22 are laid onto the cover 25, such that the width of the space between the spine panel core 22 and each of the other panel cores 21, 23 is approximately equal to the sum of the width (thickness) of the spine panel core 22, twice the width (thickness) of the cover 25, and twice the width (thickness) of the liner sheet 28 (see FIG. 5) to be affixed in a subsequent step. Further, those skilled in the art will recognize that other adhesive materials and/or methods of affixation may be used to join the panel cores 21–23 and the cover 25 instead of glue, e.g., stitching, stapling, etc. Alternatively, the panel cores 21–23 and the cover 25 may be fabricated from a single sheet, such as cardboard, or glued together in alternative configurations, as described hereinbelow and illustrated in FIGS. 9 and 10*a*.

Figure 4:
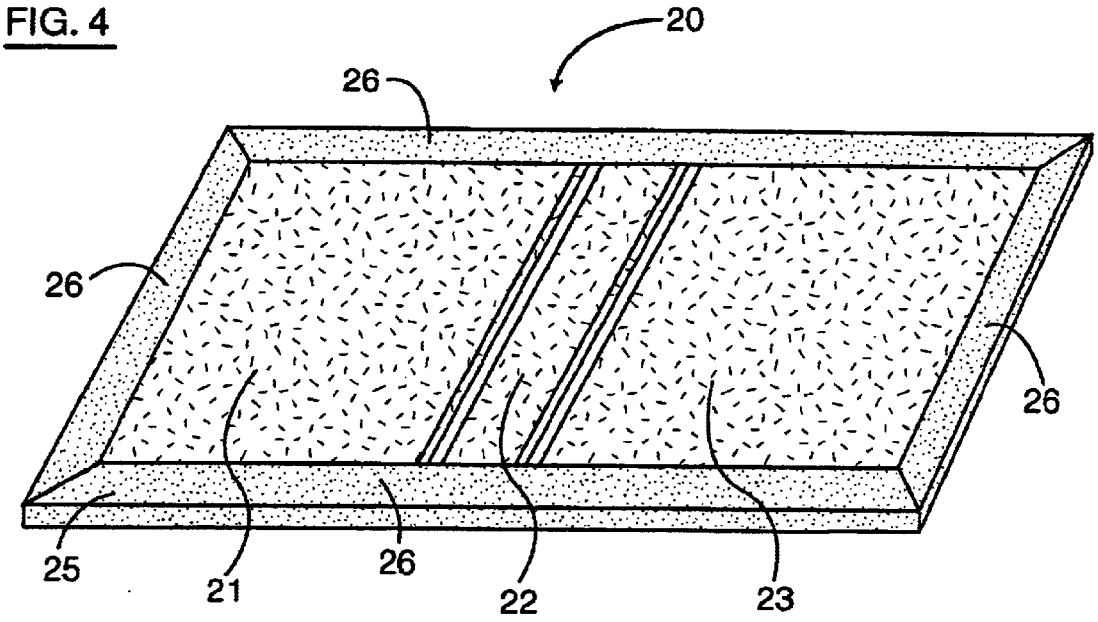
FIG. 4 is a top perspective view of an exemplary hinged cover consistent with the invention wherein the overhanging flaps of the cover are folded over and glued onto the panel cores.

With reference now to FIG. 4, the overhanging flaps 26 of the cover 25 are folded inward, over the edges of the panel cores 21–23 and then glued (or otherwise affixed, as described hereinabove) onto the exposed outer edges and/or upper surfaces of the panel cores 21–23.

Figure 5:
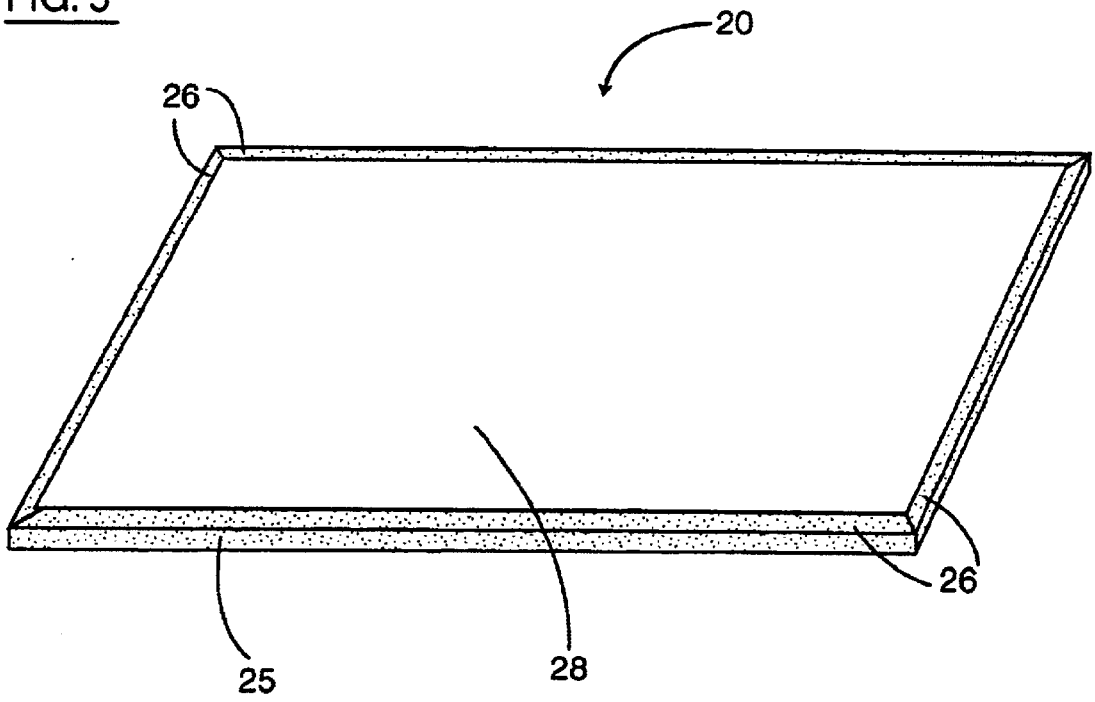

Next, as illustrated in FIG. 5, the inside liner sheet 28 is placed and glued (or otherwise affixed, as described hereinabove) onto the surface comprising the exposed upper surfaces of the panel cores 21–23 (not shown) and may also overhang a portion of the flaps 26 of the cover 25.

Figure 6:
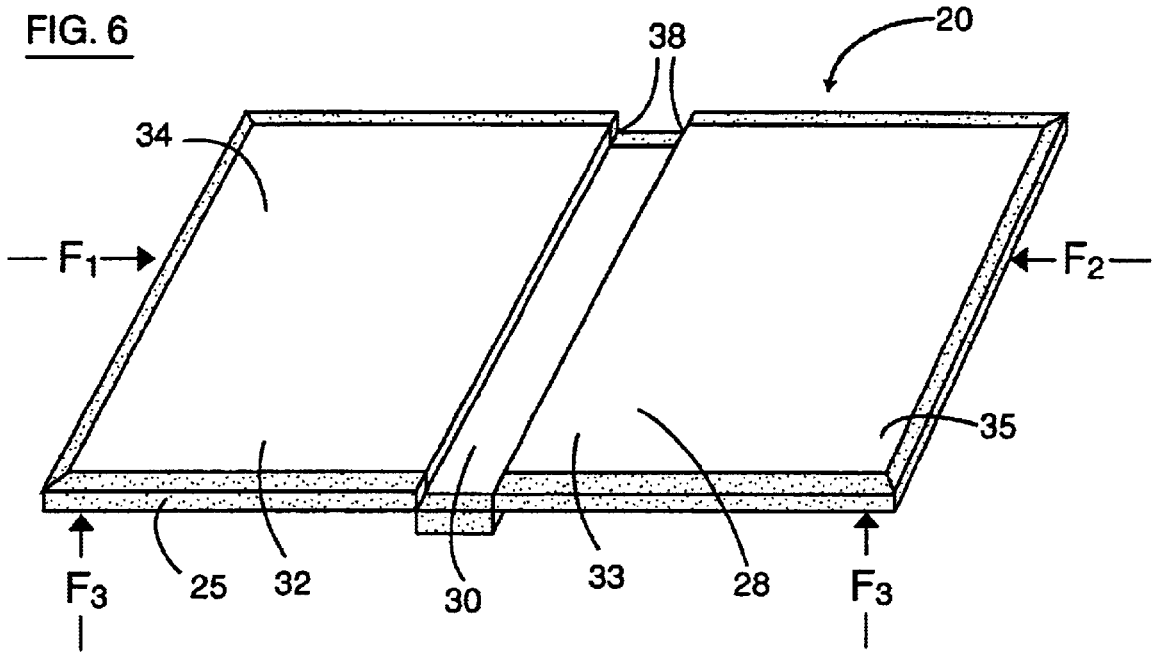
FIG. 6 is a top perspective view of an exemplary hinged cover consistent with the invention wherein the panels are raised slightly and moved towards the spine.
Figure 6A:
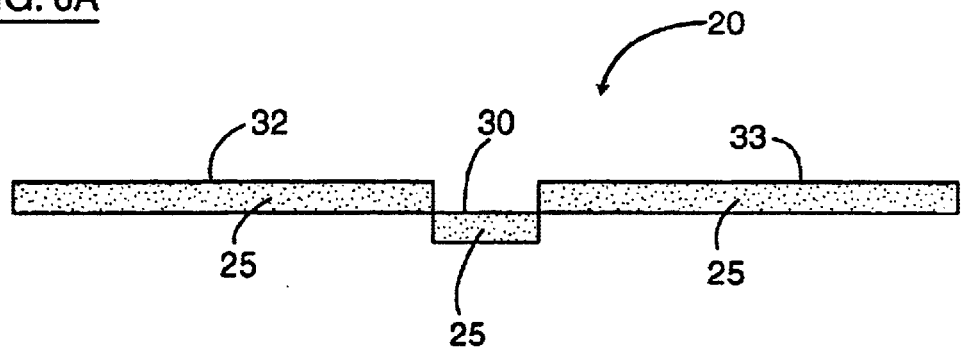
FIG. 6A is a side perspective view of the hinged cover illustrated in FIG. 6.

Turning now to FIGS. 6 and 6A, at this point in the construction, a front 32 and rear 33 panel and a spine 30 are formed by lifting the outer edges 34, 35 of the hinged cover 20 slightly (as shown, forces $F_3$) and applying an inward force $F_1$, $F_2$ to each outer edge in the direction of one another, such that the elements (i.e., liner 28 and cover 25) along the hinges 38 are forced together. When forced together, the liner 28 and cover 25 may be glued (or otherwise affixed, as described hereinabove) to one another, if adhesive is deposited therebetween prior to the liner sheet 28 being placed in the previous step.

Figure 7:
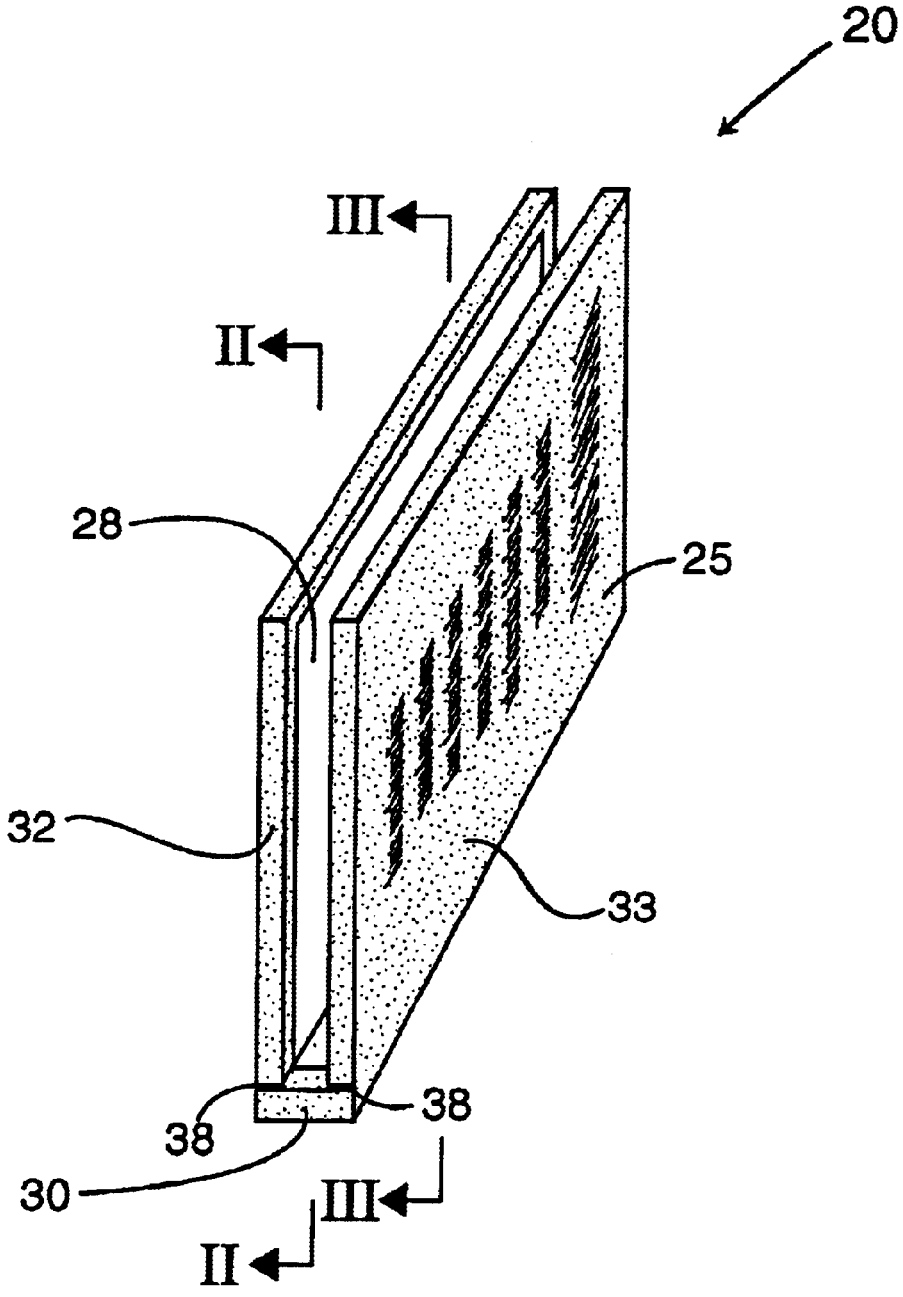
FIG. 7 is a side perspective view of an exemplary hinged cover consistent with the invention wherein the two panels are rotated to a vertical position.
Figure 8A:
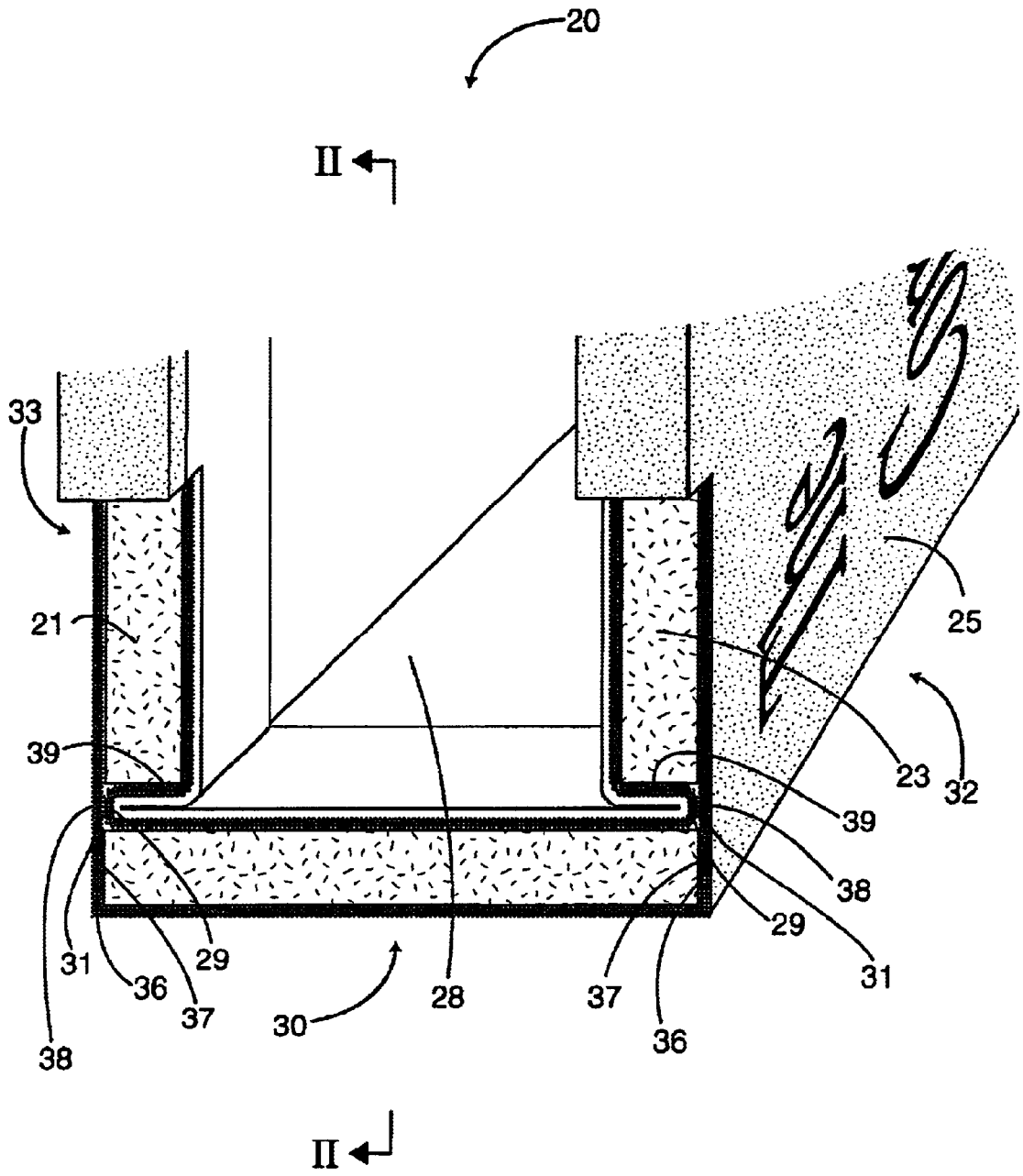
FIG. 8*a* is a cutaway view of the exemplary hinged cover illustrated in FIG. 7, at the cross-section of plane II—II.

As FIG. 7 illustrates, while the spine 30 remains stationary, the front 32 and rear 33 panels are folded up toward one another to a vertical position along the binges 38. This further joins the remaining unaffixed parts of the cover 25 and liner sheet 28 to the rest of the unit, i.e., the cover 25 and liner sheet 28 are now fully adhered to the edges of the panel cores 21, 23 and spine core 22. This process is more clearly seen in the cutaway views of FIG. 8*a* (shown at the cross-section of plane II—II of FIGS. 7) and 8*b* (shown at the cross-section of plane III—III of FIG. 7). As FIG. 8*a* illustrates, the small loose portions of cover 25 and liner sheet 28 created by each of the hinges 38 are pushed outward so that they rest under the now-horizontal edge 39 of the panel 32, 33. As shown, a bond may be formed between the inner section 29 (that was folded inward in a previous step) and outer section 31 of the cover 25, if adhesive is deposited therebetween (or otherwise affixed, as described hereinabove) prior to this step. Further, if adhesive is deposited therebetween (or otherwise affixed, as described hereinabove), a bond may be formed between each side 37 of the spine 30 and the portions 36 of the cover 25 that now abut it. The space under each panel core 21, 23 is now completely filled in with two layers of cover 25 material and two layers of inside liner 28 material. Because of the strength of the cover 25 material on the outside of the unit 20, this space cannot expand.

Figure 8B:
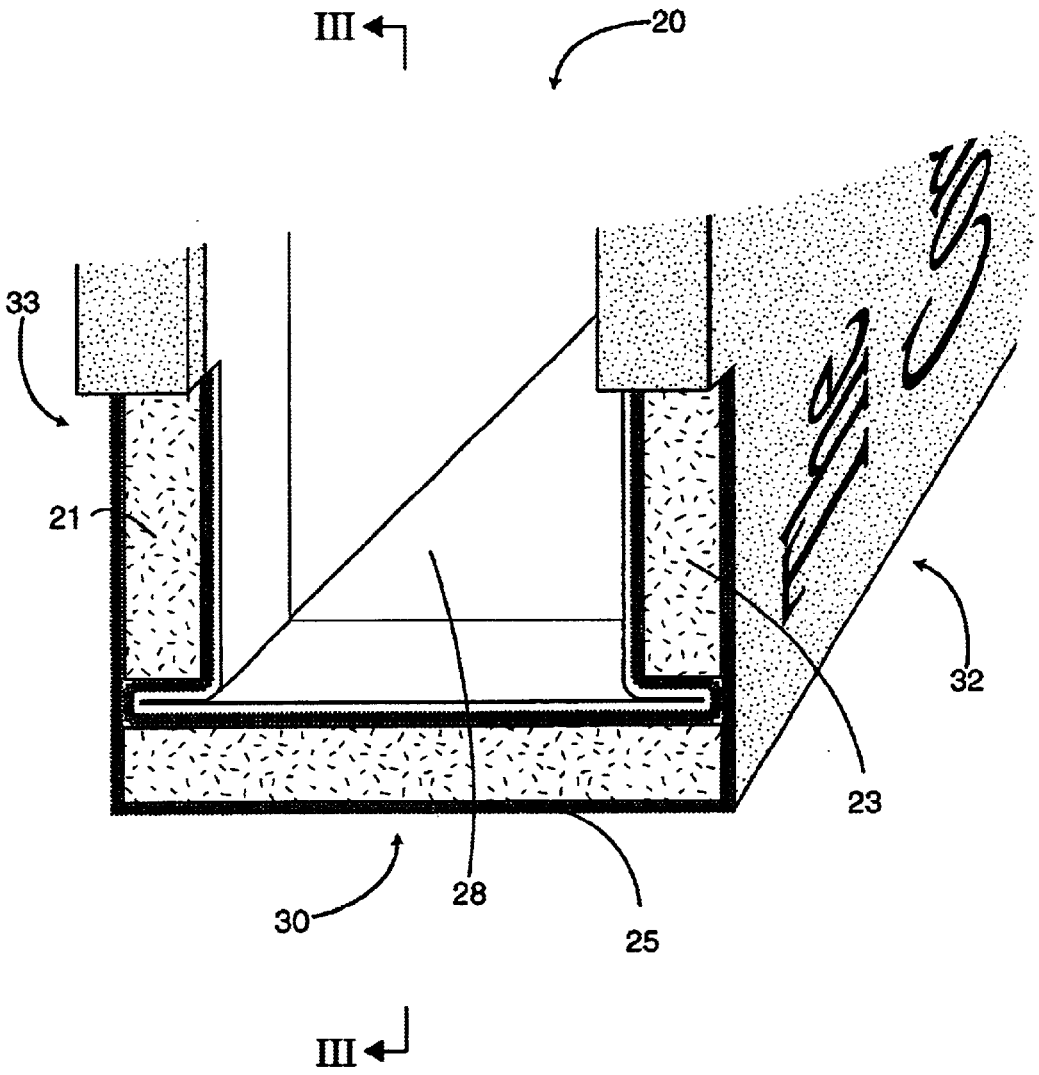
FIG. 8*b* is a cutaway view of the exemplary hinged cover illustrated in FIG. 7, at the cross-section of plane III—III.

FIG. 8*b* illustrates that, unless the overhanging flaps 26 (see FIG. 4) are large enough to cover the entire underside of the panel cores 21–23, there will be an area where there is no inner section 29 of the cover 25, i.e., at a cross-section taken along plane III—III, there may be a portion of the length of the spine 30 for which no cover material 25 extends along the inside of the hinge, depending on the dimensions of the cover material 25 used.

At this point, the construction is complete, and the outer sections 31 of the cover 25 are now taut, and the spine 30 is located such that it stops panels 32, 33 from closing substantially beyond 90 degrees relative to the horizontal surface of the spine 30, even if (1) the width (thickness) of the spine 30 is not approximately equal to the combined thickness of the front panel 32, the contents (not shown), and the back panel 33; and/or (2) the inside of the spine 30 is not attached at nearly all points along its length to whatever the contents of the hinged cover 20 might be.

The cover 25 may be constructed from flexible but strong materials, including cloth, paper, paperboard, or other pulped, fibrous and/or sturdy materials, or combinations thereof, including those derived from wood, cotton, linen, bamboo, hemp, rice straw, or polymer-derived materials. Adhesives used may include water-based glues, animal product-derived glues (including, e.g., albumen, fish and rabbit), vegetable-derived glues (including, e.g., agar-agar, arrowroot, rice starch, and potato starch), polymer-based and hot-melt glues. Non-adhesive attachment methods may include sewing, stapling, stitching, staple-like joining devices, or other mechanical adhesion means. The front, spine, and rear panel cores may be constructed from cardboard, paperboard, wood, polymer-derived materials, or other rigid, sturdy materials.

Figure 9:
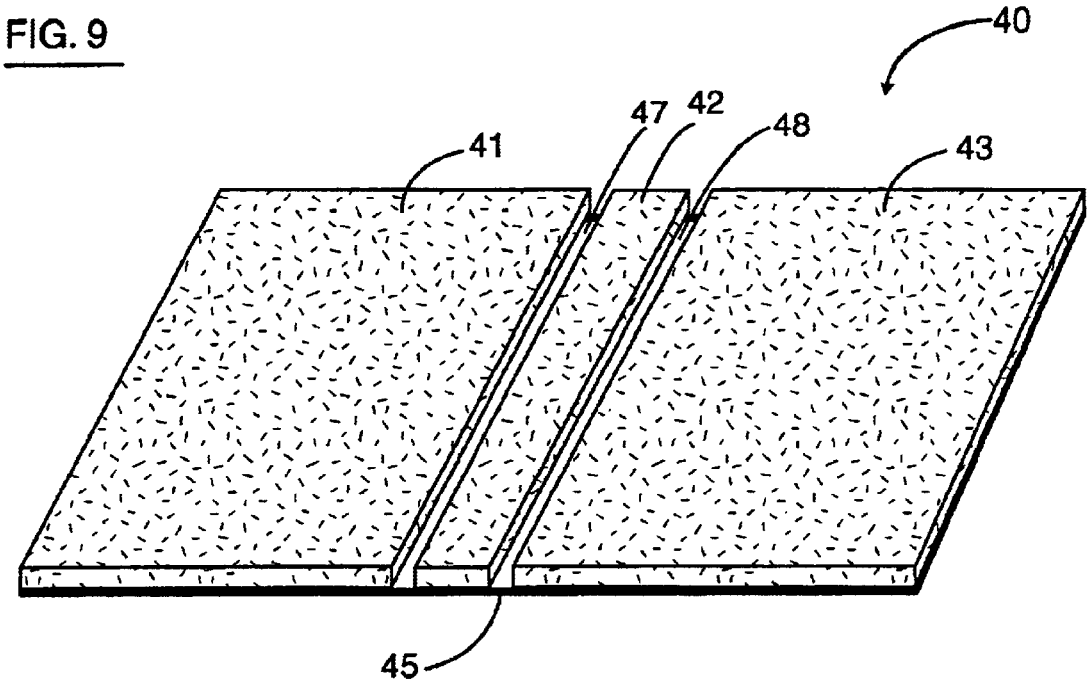
FIG. 9 is a top perspective view of another exemplary hinged cover consistent with the invention in its initial phase of construction.
Figure 10A:
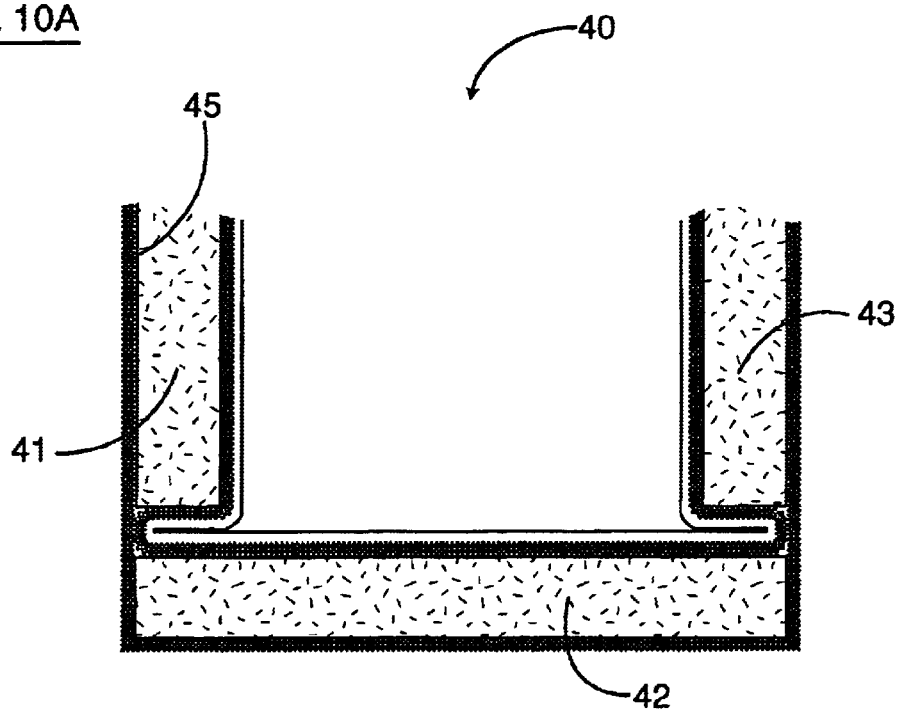
FIG. 10*a* is a side cutaway view of the fully assembled exemplary hinged cover illustrated in FIG. 9.
Figure 10B:
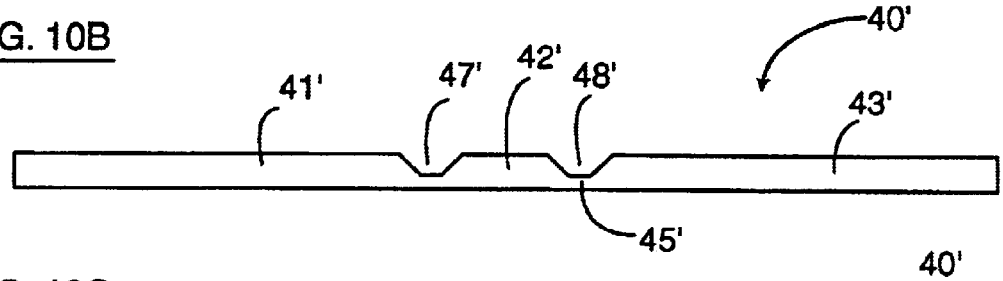
FIG. 10*b* is a side cutaway view of an exemplary hinged cover consistent with the invention in its initial phase of construction, wherein a unitary panel core is utilized, wherein the inside edges of the panels and both edges of the spine are cut at 45 degree angles.
Figure 10C:
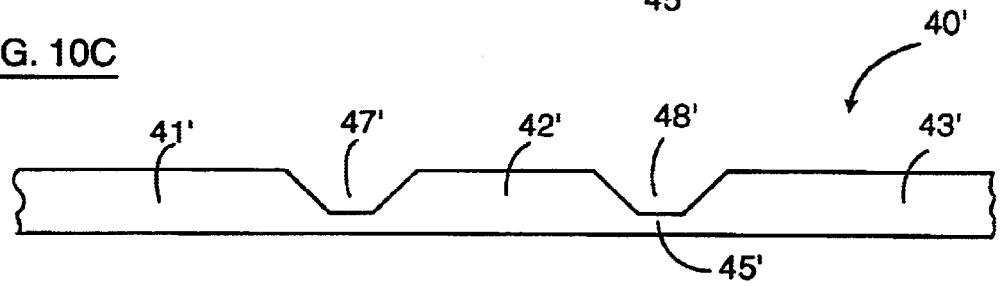
FIG. 10*c* is another side cutaway view of an exemplary hinged cover consistent with the invention in its initial phase of construction, wherein a unitary panel core is utilized, wherein the inside edges of the panels and both edges of the spine are cut at 45 degree angles.
Figure 10D:
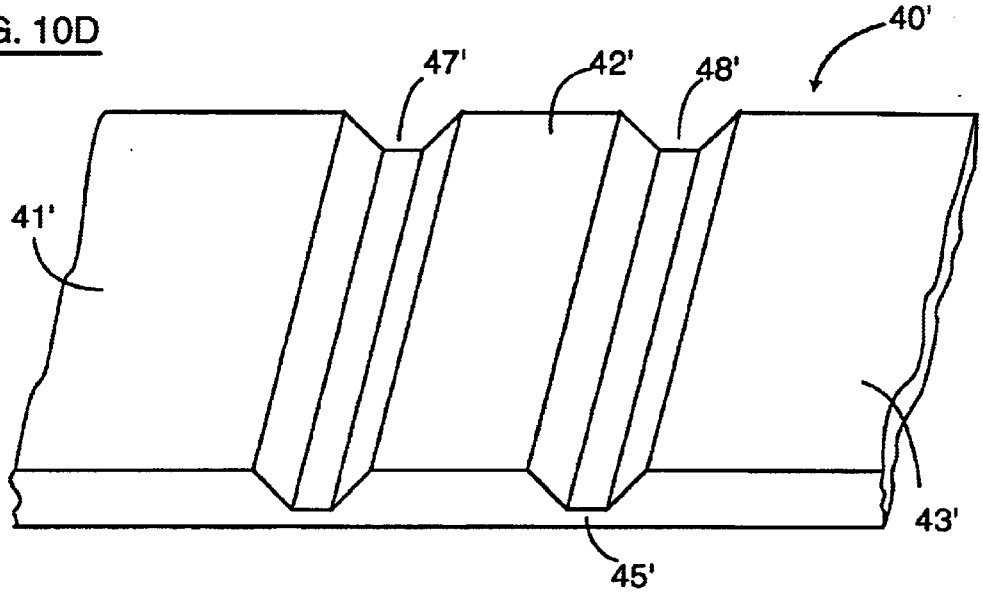
FIG. 10*d* is a top perspective view of an exemplary hinged cover consistent with the invention in its initial phase of construction, wherein a unitary panel core is utilized, wherein the inside edges of the panels and both edges of the spine are cut at 45 degree angles.
Figure 10E:
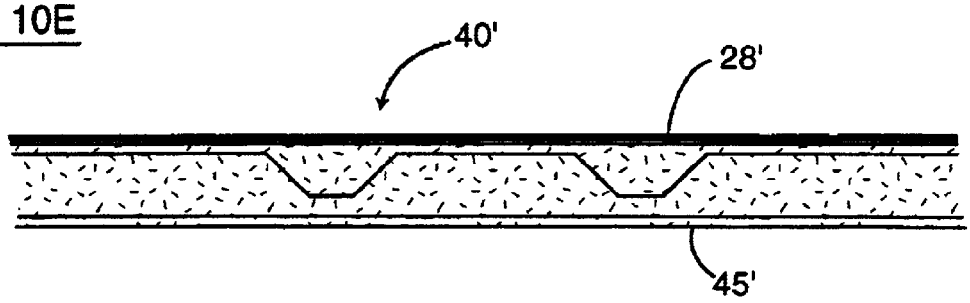
FIG. 10*e* is a side cutaway view of an exemplary hinged cover consistent with the invention, wherein the inside edges of the panels and both edges of the spine are cut at 45 degree angles, with the cover and paper liner glued in place onto the panel core unit.

As FIGS. 9 and 10*a* illustrate, in some cases, e.g., when using a cover material that is not sturdy, it may be desirable to employ a unit 40 comprising panel cores 41–43 that are pre-glued onto a sheet 45 which corresponds to the cover 25 in the previously described embodiments) comprising sturdy but flexible material. Alternatively, as FIGS. 10*b*-10*g* illustrate, a unitary component 40' may be used, wherein a thick, sturdy material such as cardboard or plastic is used, and wherein the panel cores 41'–43' are formed by excising two portions 47', 48' in the unitary component 40', such that only a "sheet" portion remains in those excised locations 47', 48'. (FIG. 10*c* is a closer view of the unitary component 40' of FIG. 10*b*, and FIG. 10*d* is a top perspective view of the same unitary component 40'.) FIG. 10*e* is a side cutaway view of an exemplary hinged cover 40' consistent with the invention, wherein the cover 45' and paper liner 28' are glued in place onto the unitary panel 40'.

The unitary component 40' or other such unit 40 may further comprise overhanging flaps (not shown), as in the previously described embodiments, which may be formed by excising material, or by gluing onto panel cores 41–43 (or 41'–43') a sheet 45 (or 45') having overhanging portions.

Figure 10F:
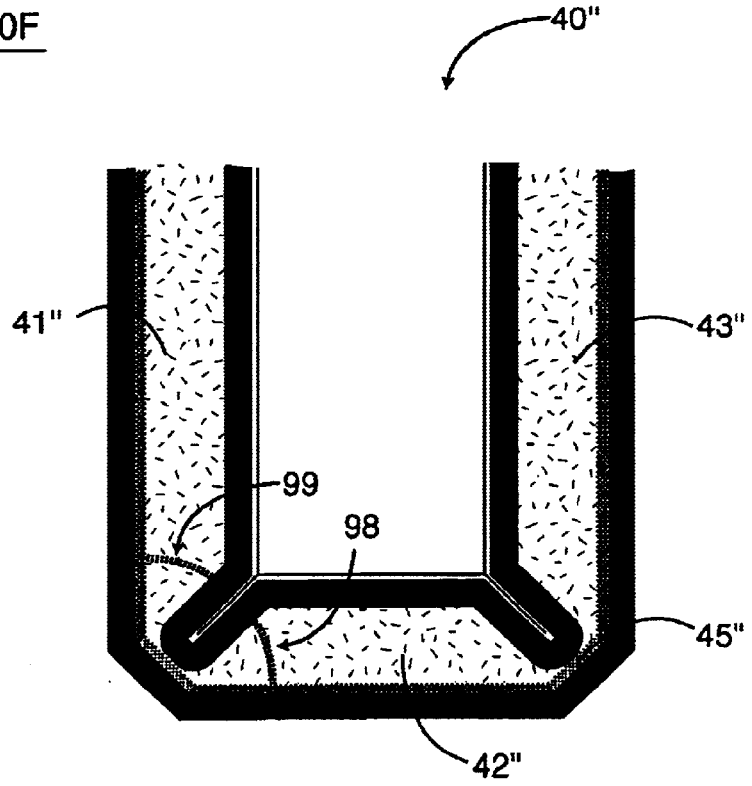
FIG. 10*f* is a side cutaway view of another exemplary hinged cover consistent with the invention, wherein the two panels are rotated to a vertical position, and wherein the inside edges of the panels and both edges of the spine are cut at 45 degree angles.
Figure 10G:
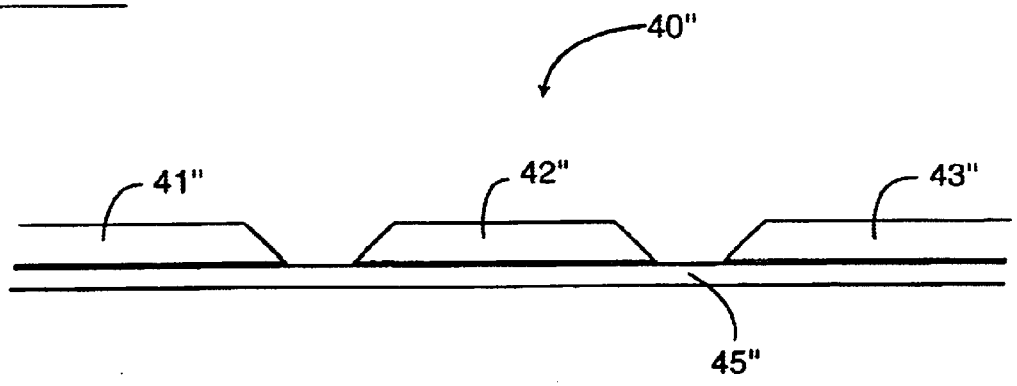
FIG. 10*g* is an exploded side view of an exemplary hinged cover consistent with the invention, wherein the panels and spine are separate pieces attached to a sheet of flexible material, and wherein the inside edges of the panels and both edges of the spine are cut at 45 degree angles.

In another embodiment 40", as shown in FIGS. 10*f*(a side cutaway view) and 10*g* (an exploded side view), the edges of the spine 42" and core panels 41", 43" may be cut or otherwise formed to meet at an angle other than 90 degrees, so long as the spine 42" and core panels 41", 43" meet at any predetermined angle, based on the spine 42" serving as a hinge stop for each panel 41", 43". Thus, each panel 41", 43", when rotated toward the other panel 41", 43", is constrained from rotating substantially beyond a certain angle with respect to the spine 42" (as illustrated in FIG. 10*f*). Such a construction may comprise three separate parts 41"–43" glued to a sheet 45" of paper/plastic or other material, or may comprise a unitary panel, as described hereinabove. Additionally, a cover 45" and/or paper liner 28" may be disposed as described above.

As shown in FIGS. 10*b*-10*g*, the inside edges of the panels and both edges of the spine are cut at 45 degree angles; the remaining figures herein show the angle of the inside edge of the panel to be 0 degrees, while the angle of the outside edge of the spine to be 90 degrees. These configurations are but exemplary of the invention, and other angular configurations are possible. For example, (as seen in FIG. 10*f*) in order for the panel cores 41', 43' to remain at right angles with respect to the spine core 42' when the unit is in a closed position, the sum of the angle 99 of an inside edge of a panel 41', 43' (here, 45 degrees) and the angle 98 of an outside edge of the spine 42' to which it interfaces (here, 45 degrees), with both angles measured relative to the sheet 45', is 90 degrees. Of course, the angles could be 30 degrees/60 degrees, 45 degrees /45 degrees, 0 degrees/90 degrees (as illustrated in and described above with respect to FIGS. 3 through 10*a*), or any other combination of angles whose sum is 90 degrees, in order for the spine core 42" to stop the travel of either panel 41', 43' at 90 degrees. In some embodiments, certain uses of the present invention may dictate that the panels 41', 43' stop rotational travel at a number of degrees greater than or less than 90.

Figure 11:
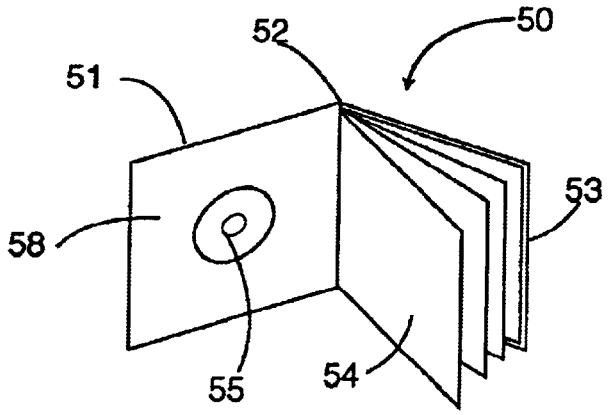
FIG. 11 is an elevated perspective view of an exemplary CD holder consistent with the invention.

As illustrated in FIGS. 11 through 14, a hinged cover consistent with the invention may also serve as a holder or package for storing CDs and accompanying printed matter. Turning now to FIG. 11, an exemplary CD holder 50 is shown, comprising an exemplary hinged cover 20 or 40 as described hereinabove, with a front panel 51, spine 52, and rear panel 53, a boss 55 for retaining a CD, and a booklet 54 comprising a plurality of pages. (For ease of viewing, not all components of the cover 20 or 40 are shown in FIG. 11, as they have already been described hereinabove with reference to FIGS. 3 through 10). The booklet 54 may be glued or otherwise affixed to the inside of the rear panel 53 (e.g., to the liner 58), and the CD boss 55 may be glued onto the inside of the front panel 51 (e.g., to the liner 58), or alternatively, a unitary liner 58 (e.g., manufactured from a polymer-based or other moldable material) may comprise an integrated CD boss 55.

Figure 12:
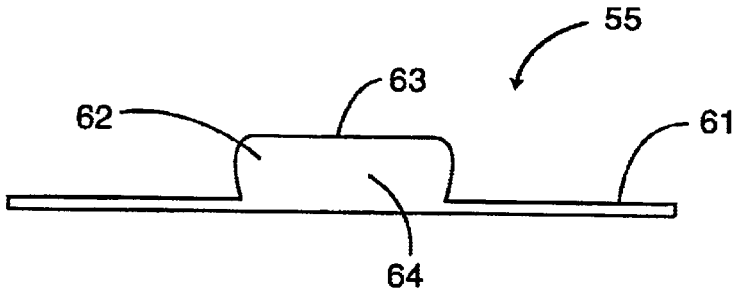
FIG. 12 is a side perspective view of an exemplary CD boss used in an exemplary CD holder consistent with the invention.
Figure 13:
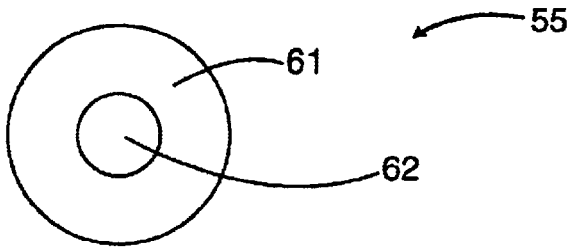
FIG. 13 is a top perspective view of an exemplary CD boss used in an exemplary CD holder consistent with the invention.

As illustrated in FIGS. 12 and 13, an exemplary CD boss 55 is a unitary element and comprises a lower circular member 61 and an upper circular member 62. The lower circular member has a diameter greater than that of the center hole of a standard CD (e.g., 45 mm). The upper circular member is tapered, such that its upper surface 63 has a diameter slightly greater than that of a standard CD (e.g. 15.3 mm), and the lower portion 64 has a diameter approximately equal to or slightly less than that of a standard CD (e.g. 14.8 mm). For this exemplary CD boss 55, the lower circular member 61 has a thickness of 1.3 mm, and the upper circular member 62 has a thickness of 2 mm.

Figure 1A:
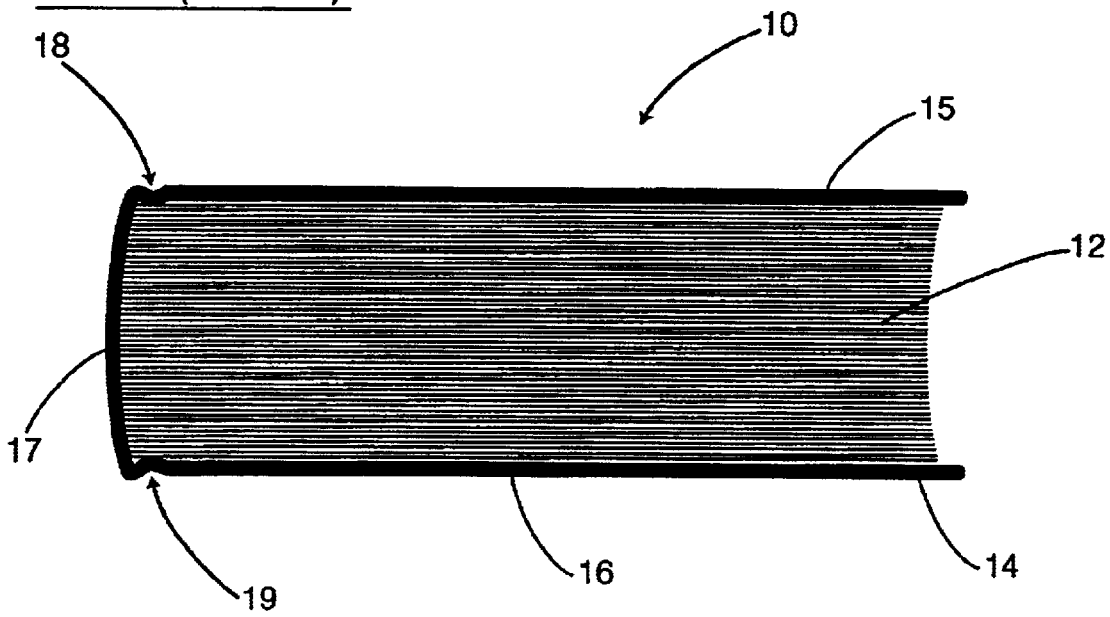
FIG. 1A (Prior Art)
FIG. 1A is a side perspective view of an exemplary hardbound book known in the art.
Figure 1B:
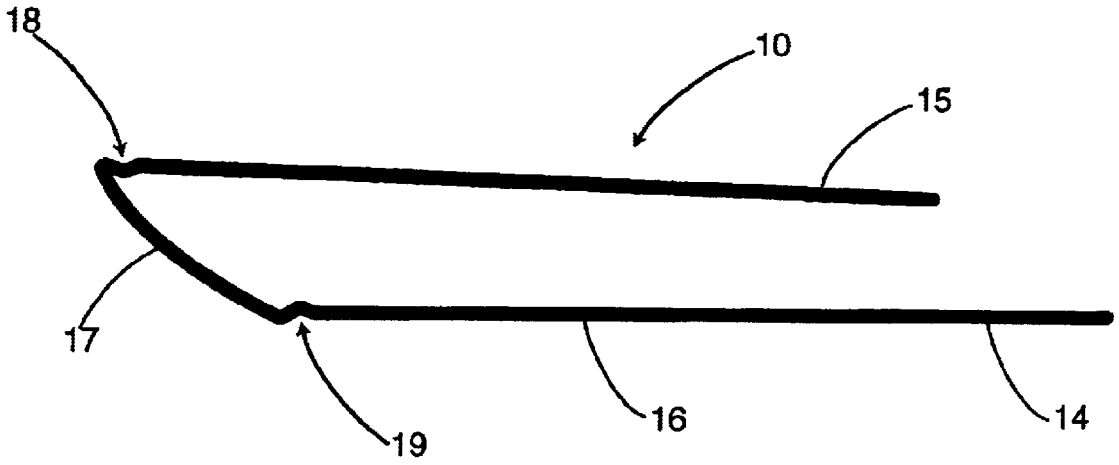
FIG. 1B (Prior Art)
FIG. 1B is a side perspective view of an exemplary hardbound book known in the art, with its pages removed.
Figure 1C:
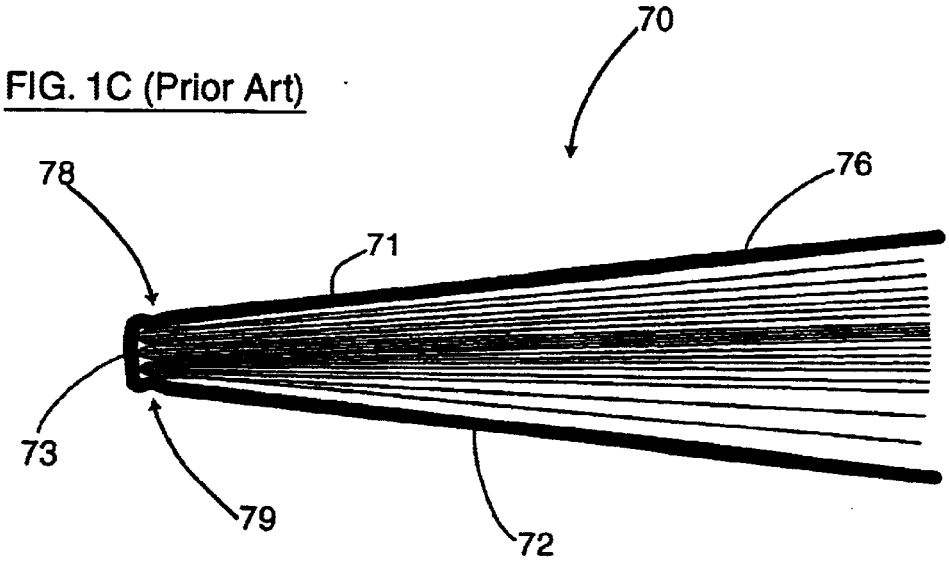
FIG. 1C (Prior Art)
FIG. 1C is a side perspective view of another exemplary hardbound book known in the art.
Figure 2:
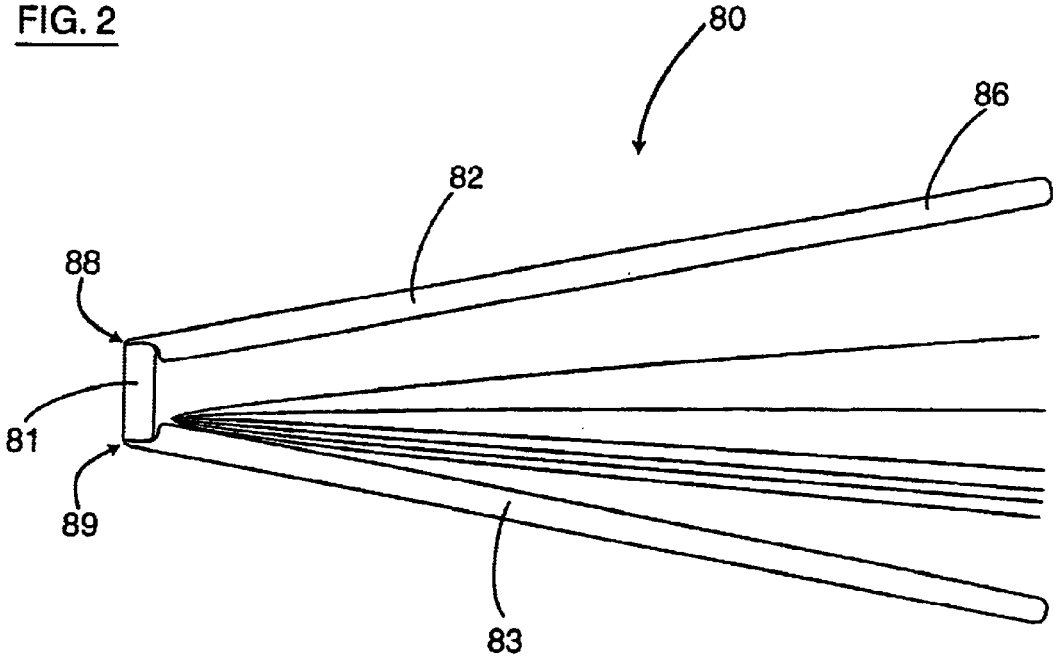
FIG. 2 is a side perspective view of an exemplary book-like object comprising an exemplary hinged cover consistent with the present invention.
Figure 2A:
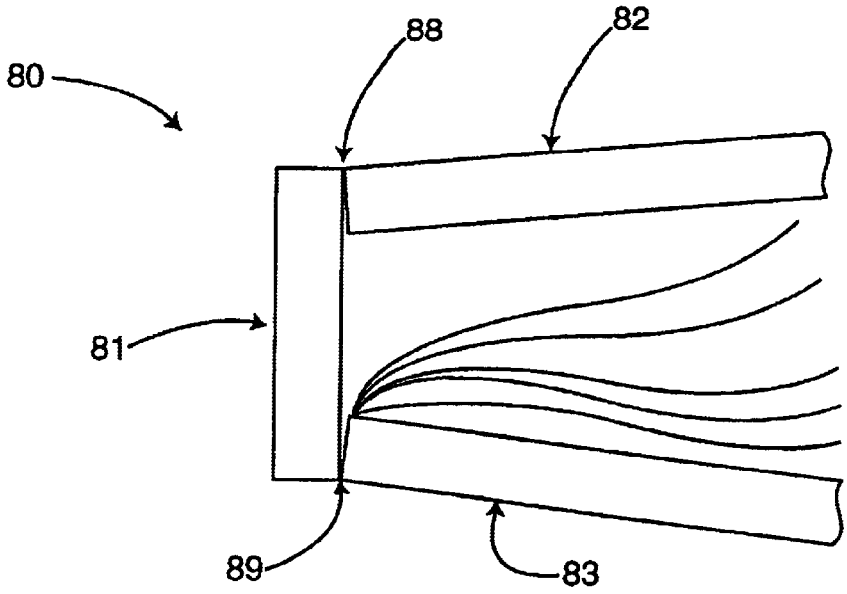
FIG. 2A is a magnified side perspective view of the hinged cover illustrated in FIG. 2.
Figure 14:
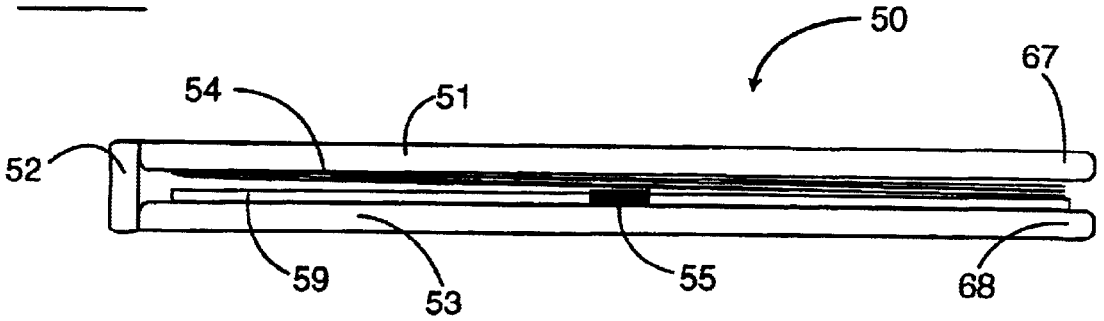
FIG. 14 is a side perspective view of the exemplary CD holder of FIG. 11, with a CD being held in place.

With reference now to FIG. 14, a side perspective view of the exemplary CD holder 50 of FIG. 11 is shown, with a CD 59 being held in place. The CD 59 is held in place by a boss 55 attached to the rear panel 53. A booklet 54 comprising a plurality of pages is attached to the front panel 51. Since the front 51 and rear 53 panels and the spine 52 are rigid, and since the front 51 and rear 53 panels cannot close substantially beyond 90 degrees relative to the horizontal surface of the spine 52, the CD holder 50 when closed (i.e., the front 51 and rear 53 panels brought together) maintains an aesthetically pleasing appearance where all angles are essentially 90 degrees. Because of the rigidity of these 90-degree angles, the CD holder maintains its pleasing appearance even when squeezed in among other books in a bookshelf—the spine does not collapse, and the title may be read with ease. It should be understood that, when the cover is "closed" (i.e., the front 51 and rear 53 panels are brought together), the boss 55 may contact the booklet 54 (or inside of the front panel 51, in an embodiment having no booklet), and/or the outer edges 67, 68 of the front 51 and rear 53 panels may contact one another. Of course, attachment means other than a boss 55 may be used to hold a CD (or other contents) in place, e.g., a pocket, retaining clip or lip, etc. It should further be recognized that a plurality of CDs may also be held in place inside a single cover, whether arranged horizontally, vertically, in rows, or otherwise on the inside of one panel, or even on top of one another (i.e., one CD held to the inside of the front panel, and the other held to the inside of the rear panel). This embodiment may be suitable for a wide range of uses for CDs, CD-ROMs, DVDs, diskettes, and other media, which may contain music, video, pictures, software or other data stored thereon. For example, one specific use would be a "mini-photo album" for a CD-ROM containing photographs, wherein an included booklet contains printed versions of some or all of the photographs stored on the disc, and a cloth cover provides an attractive miniature album-type device for housing the printed photographs and the CD-ROM. It should also be noted that other embodiments of the present invention may include additional features, e.g., flaps or panels at the top and/or bottom of the device and/or side (e.g., as seen in FIG. 2) to prevent dust or other matter from entering between the cover panels when the device is stored on its end (e.g., on a bookshelf with the spine facing outward, as an ordinary hardcover book would be stored).

The embodiments that have been described herein, however, are but some of the several which utilize this invention and are set forth here by way of illustration but not of limitation. It is obvious that many other embodiments, which will be readily apparent to those skilled in the art, may be made without departing materially from the spirit and scope of the invention.

What is claimed is:

1. A hinged cover comprising:

a spine having an inner surface; and two rigid panels, each said panel coupled to said spine and disposed rotatably with respect to said spine and having an outer surface;

wherein the outer surfaces of said rigid panels are essentially coplanar with the inner surface of said spine when the hinged cover is opened to a position in which the rigid panels are disposed at 180 degrees with respect to each other;

wherein said spine serves as a hinge stop for each said rigid panel, such that each said panel, when rotated toward the other said panel, is constrained from rotating substantially beyond 90 degrees with respect to said spine; and wherein the inward rotation of each said rigid panel is constrained by contact with said spine and independently of contact with any other surface.

2. A hinged cover as claimed in claim 1, further comprising, disposed between said two rigid panels, at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

3. A hinged cover comprising:

a spine having an inner surface; and two rigid panels having outer surfaces, at least one said panel hingeably coupled to said spine, such that the rotation of said panel is substantially limited by a configuration between said panel and said spine wherein said spine serves as a hinge stop for said panels;

wherein the outer surfaces of said rigid panels are essentially coplanar with the inner surface of said spine when the hinged cover is opened to a position in which the rigid panels are disposed at 180 degrees with respect to each other; and wherein the inward rotation of each said rigid panel is constrained by contact with said spine and independently of contact with any other surface.

4. A hinged cover as claimed in claim 3, further comprising, disposed between said two rigid panels, at least one of the following: at least one sheet of paper, a CD, a CD-ROM, a diskette, a tape, a boss for holding a CD or CD-ROM, a device for holding a storage medium for audio, music, video, pictures, software, or data.

5. A hinged cover comprising:

a spine having an inner surface and an outside surface; and two rigid panels having outer surfaces, said rigid panels hingeably coupled to said spine, wherein the axis of travel about which at least one said panel rotates is situated on the outside surface of said spine;

wherein the outer surfaces of said rigid panels are essentially coplanar with the inner surface of said spine when the hinged cover is opened to a position in which the rigid panels are disposed at 180 degrees with respect to each other; and wherein the inward rotation of each said rigid panel is constrained by contact with said spine and independently of contact with any other surface.

6. A hinged cover as claimed in claim 5, further comprising, disposed between said two rigid panels, at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

7. A book cover comprising:

a spine panel having an inner surface; and two rigid cover panels having outer surfaces, said rigid cover panels disposed rotatably with respect to said spine panel such that said spine panel serves as a hinge stop for each said rigid cover panel, wherein the endpoint of inward rotation of each said rigid cover panel is independent of the thickness of any contents housed within said book cover;

wherein the outer surfaces of said rigid cover panels are essentially coplanar with the inner surface of said spine panel when the book cover is opened to a position in which the rigid panels are disposed at 180 degrees with respect to each other; and wherein the inward rotation of each said rigid cover panel is constrained by contact with said spine panel and independently of contact with any other surface.

8. A book cover as claimed in claim 7, further comprising, disposed between said two rigid cover panels, at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

9. An outside-hinged cover for housing at least one object therein comprising:

a spine panel having an inner surface; and front and rear rigid cover panels having outer surfaces, said rigid cover panels disposed rotatably with respect to said spine; wherein said at least one object is disposed between said rigid cover panels;

wherein the thickness of said spine panel is greater than the combined thickness of the front panel, all of the objects housed therein, and the rear panel;

wherein said spine panel serves as a hinge stop for each said rigid cover panel, such that each said rigid cover panel, when rotated toward the other said rigid cover panel, is constrained from rotating substantially beyond 90 degrees with respect to said spine panel;

wherein the outer surfaces of said rigid cover panels are essentially coplanar with the inner surface of said spine panel when the outside-hinted cover is opened to a position in which the rigid cover panels are disposed at 180 degrees with respect to each other; and wherein the inward rotation of each said rigid cover panel is constrained by contact with said spine panel and independently of contact with any other surface.

10. An outside-hinged cover as claimed in claim 9, further comprising, disposed between said two rigid cover panels, at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

11. An outside-hinged cover for housing at least one object therein comprising:

a spine panel having an inner surface; and two rigid cover panels having outer surfaces, said rigid cover panels disposed rotatably with respect to said spine;

wherein said spine panel and said rigid cover panels are disposed such that each said rigid cover panel, when rotated toward the other said rigid cover panel, is constrained from rotating substantially beyond 90 degrees with respect to said spine panel, independent of whether any of said objects stored therein are attached to the inside of said spine panel;

wherein the outer surfaces of said rigid cover panels are essentially coplanar with the inner surface of said spine panel when the outside-hinged cover is opened to a position in which the rigid cover panels are disposed at 180 degrees with respect to each other; and wherein the inward rotation of each said rigid cover panel is constrained by contact with said spine panel and independently of contact with any other surface.

12. An outside-hinged cover as claimed in claim 11, further comprising, disposed between said two rigid cover panels, at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

13. A method of constructing a cover comprising:

forming a cover having rigid front, rear and spine panels by disposing a rigid front, rear, and spine panel core onto a sheet of pliable material, such that the width of the space between said spine panel core and said other panel cores is based on at least the sum of the thickness of said spine panel core and twice the thickness of said sheet of pliable material;

wherein said spine panel has an inner surface;

wherein said rigid front and rear panels are formed so as to have outer surfaces that are essentially coplanar with the inner surface of said spine panel when the cover is opened to a position in which the rigid front and rear panels are disposed at 180 degrees with respect to each other; and wherein the inward rotation of each said rigid panel is constrained by contact with said spine panel and independently of contact with any other surface.

14. A method as claimed in claim 13, further comprising disposing between said front and rear rigid panels at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

15. A method of constructing a cover comprising:

hingeably coupling two rigid panels having outer surfaces to a spine having an inner surface, wherein each said panel, when rotated toward the other said panel, is constrained from rotating substantially beyond 90 degrees with respect to said spine based on said spine serving as a hinge stop for each said panel, wherein the outer surfaces of said rigid panels are essentially coplanar with the inner surface of said spine when the cover is opened to a position in which the rigid panels are disposed at 180 degrees with respect to each other, and wherein the inward rotation of each said rigid panel is constrained by contact with said spine and independently of contact with any other surface.

16. A method as claimed in claim 15, further comprising disposing between said rigid panels at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

17. A method of constructing a book cover comprising:

hingeably coupling two rigid panels having outer surfaces to a spine having an inner surface and an outside surface, in a configuration, wherein said spine serves as a hinge stop for each said rigid panel, wherein the axis of travel about which at least one said panel rotates is situated on the outside surface of said spine, and the endpoint of inward rotation of each said panel is independent of the thickness of a plurality of pages housed in said book cover, wherein the outer surfaces of said rigid panels are essentially coplanar with the inner surface of said spine when the book cover is opened to a position in which the rigid panels are disposed at 180 degrees with respect to each other; and wherein the inward rotation of each said rigid panel is constrained by contact with said spine and independently of contact with any other surface.

18. A method as claimed in claim 17, further comprising disposing between said rigid panels at least one of the following: at least one sheet of paper, a CD, a CD-ROM, a diskette, a tape, a boss for holding a CD or CD-ROM, a device for holding a storage medium for audio, music, video, pictures, software, or data, a stamp collection, a coin collection, a general collection of items, a photograph, a cassette, a scrapbook page, an electronic storage medium.

19. A compact disc cover comprising:

a spine having an inner surface;

two rigid panels, each said panel having an outer surface and being coupled to said spine and disposed rotatably with respect to said spine;

a CD holder disposed between said rigid panels; and a plurality of pages disposed between said rigid panels;

wherein each said panel, when rotated toward the other said panel, is constrained from rotating substantially beyond 90 degrees with respect to said spine based on said spine serving as a hinge stop for each said rigid panel;

wherein the outer surfaces of said rigid panels are essentially coplanar with the inner surface of said spine when the compact disc cover is opened to a position in which the rigid panels are disposed at 180 degrees with respect to each other; and wherein the inward rotation of each said rigid panel is constrained by contact with said spine and independently of contact with any other surface.

20. A data storage medium product comprising:

a spine having an inner surface and an outside surface;

two rigid panels having outer surfaces, said rigid panels hingeably coupled to said spine;

a data storage medium; and a plurality of pages disposed between said rigid panels;

wherein the axis of travel about which at least one said panel rotates is situated on the outside surface of said spine;

wherein the outer surfaces of said rigid panels are essentially coplanar with the inner surface of said spine when the data storage medium product is opened to a position in which the rigid panels are disposed at 180 degrees with respect to each other; and wherein the inward rotation of each said rigid panel is constrained by contact with said spine and independently of contact with any other surface.

21. A hinged cover comprising:

a spine having an outside edge and an inner surface;

at least one panel having an inside edge and a bottom surface, said panel hingeably coupled to said outside edge of said spine, wherein said panel is adapted to interface with said spine, said spine serving as a hinge stop;

wherein the sum of the angle of said inside edge of said panel measured relative to said bottom surface of said panel and the angle of said outside edge of said spine measured relative to said bottom surface of said panel is 90 degrees;

wherein the bottom surface of said panel is essentially coplanar with the inner surface of said spine when the hinged cover is opened to a position in which said panel and said spine lie in substantially parallel lines; and wherein the inward rotation of each said panel is constrained by contact with said spine and independently of contact with any other surface.

22. A hinged cover comprising:

a sheet of pliable material; and rigid front, rear, and spine panel cores coupled to said sheet of pliable material, said front and rear panel cores disposed opposite one another adjacent said spine panel core, said panel cores having substantially trapezoidal cross-sections, the cross-section of said spine panel core having two outside edges and a bottom edge, and the cross-section of said front and rear panel cores having an inside edge and a bottom edge;

wherein the sum of the angle of said inside edge of said front or rear panel core measured relative to said bottom edge of said front or rear panel core and the angle of said adjacent outside edge of said spine panel core measured relative to said bottom surface of said spine panel core is 90 degrees.

* * * * *